US011166513B2

(12) United States Patent
King et al.

(10) Patent No.: US 11,166,513 B2
(45) Date of Patent: Nov. 9, 2021

(54) RATCHET MECHANISM FOR PROTECTIVE HELMET HEADBAND

(71) Applicant: E.D. Bullard Company, Cynthiana, KY (US)

(72) Inventors: Matthew King, Lexington, KY (US); Matthew G. Plunkett, Lexington, KY (US); William Chad Wedding, Lexington, KY (US)

(73) Assignee: E.D. Bullard Company, Cynthiana, KY (US)

( * ) Notice: Subject to any disclaimer, the term of this patent is extended or adjusted under 35 U.S.C. 154(b) by 229 days.

(21) Appl. No.: 16/656,976

(22) Filed: Oct. 18, 2019

(65) Prior Publication Data

US 2020/0121017 A1 Apr. 23, 2020

Related U.S. Application Data

(60) Provisional application No. 62/748,014, filed on Oct. 19, 2018.

(51) Int. Cl.
*A42B 3/14* (2006.01)

(52) U.S. Cl.
CPC ..... *A42B 3/145* (2013.01); *A42B 3/14* (2013.01)

(58) Field of Classification Search
CPC ..... A42B 3/145; A42B 3/14
See application file for complete search history.

(56) References Cited

U.S. PATENT DOCUMENTS 2,926,406 A * 3/1960 Edwards ..... A42B 3/145 24/68 B
4,888,831 A 12/1989 Oleson
5,321,416 A * 6/1994 Bassett ..... A42B 3/145 345/8

(Continued)

FOREIGN PATENT DOCUMENTS

KR 10-1674630 B1 11/2016

OTHER PUBLICATIONS

3M, Hard Hat Suspension Replacement H-700-RS4, 4-point Ratchet Standard, 20 EA/Case, https://www.3m.com/3M/en_US/company-us/all-3m-products/~/3M-Hard-Hat-Suspension-Replacement-H-700-RS4-4-point-Ratchet-Standard-20-EA-Case/?N=5002385+3294759150&rt=rud (downloaded Jan. 31, 2020).

(Continued)

*Primary Examiner* — Khaled Annis
(74) *Attorney, Agent, or Firm* — Stites & Harbison, PLLC; David W. Nagle, Jr.

(57) ABSTRACT

A ratchet mechanism for a headband of a protective helmet controls movement of overlapping rear portions of the headband with respect to one another includes a housing defining an internal cavity. The ratchet mechanism further includes an adjustment element with a pinion configured to engage respective rack gears of the overlapping rear portions of the headband within the internal cavity defined by the housing, along with a spring, which provides a torque that biases the adjustment element to a home position. The ratchet mechanism further includes a knob that is configured for movement between a first position in which it engages the pinion and controls rotation of the adjustment element, and a second position in which it disengages from the pinion, such that the spring will return the adjustment element to the home position.

23 Claims, 12 Drawing Sheets

(56) References Cited

U.S. PATENT DOCUMENTS

| | | | | |
|---|---|---|---|---|
| 5,950,245 | A | 9/1999 | Binduga | |
| 5,991,085 | A * | 11/1999 | Rallison | G02B 27/017 345/8 |
| 6,369,952 | B1 * | 4/2002 | Rallison | G02B 27/017 359/630 |
| 6,609,254 | B2 | 8/2003 | Bielefeld et al. | |
| 6,862,747 | B2 | 3/2005 | Oleson | |
| 7,000,262 | B2 | 2/2006 | Bielefeld | |
| 7,043,772 | B2 | 5/2006 | Bielefeld et al. | |
| 7,174,575 | B1 | 2/2007 | Scherer | |
| 7,213,271 | B1 | 5/2007 | Bielefeld | |
| 8,015,625 | B2 | 9/2011 | Grim et al. | |
| 9,179,729 | B2 | 11/2015 | Cotterman et al. | |
| 9,572,392 | B2 | 2/2017 | Klotz et al. | |
| 10,362,836 | B2 * | 7/2019 | Hammerslag | A43B 5/16 |
| 2006/0156517 | A1 * | 7/2006 | Hammerslag | A43C 1/04 24/68 SK |
| 2008/0109947 | A1 * | 5/2008 | Dubois | A42B 3/145 2/414 |
| 2008/0295229 | A1 * | 12/2008 | Fang | A42B 3/145 2/418 |
| 2009/0031482 | A1 | 2/2009 | Stokes et al. | |
| 2010/0050325 | A1 * | 3/2010 | Wang-Lee | A42B 3/145 2/418 |
| 2010/0095438 | A1 * | 4/2010 | Moelker | A42B 1/22 2/418 |
| 2010/0139057 | A1 * | 6/2010 | Soderberg | A61F 5/0118 24/68 R |
| 2010/0159798 | A1 * | 6/2010 | Bertrand | A63H 1/02 446/259 |
| 2011/0112448 | A1 * | 5/2011 | Wu | A61H 7/006 601/85 |
| 2012/0246974 | A1 | 10/2012 | Hammerslag et al. | |
| 2014/0094728 | A1 * | 4/2014 | Soderberg | A43C 11/008 602/6 |
| 2015/0059065 | A1 * | 3/2015 | Klotz | A42B 1/22 2/418 |
| 2015/0107006 | A1 | 4/2015 | Chen | |
| 2016/0270470 | A1 | 9/2016 | Hickman et al. | |
| 2018/0299681 | A1 * | 10/2018 | Eastwood | G02B 27/0176 |
| 2020/0121017 | A1 * | 4/2020 | King | A42B 3/145 |
| 2020/0213708 | A1 * | 7/2020 | Wang | G02B 27/0176 |

OTHER PUBLICATIONS

Grainger, "Hard Hat Suspension, Ratchet (4-Point), 3M", Video, available at https://www.grainger.com/product/3M-Hard-Hat-Suspension-21E396 (downloaded Jan. 31, 2020).

Mine Safety Appliances Company, Fas-Trac® III Suspension, https://us.msasafety.com/Head-Protection/Hard-Hat-Accessories/Fas-Trac%C2%AE-III-Suspension/p/000060001400001006 (downloaded Jan. 31, 2020).

Black Diamond, Vector Helmet, https://www.blackdiamondequipment.com/en/climbing-helmets/vector-BD620213_cfg.html (downloaded Jan. 31, 2020).

Adventure Rig, "The Vector Helmet by Black Diamond [Review]", Video, available at https://www.youtube.com/watch?v=aA2XPM3-4CA (downloaded Jan. 31, 2020).

The MTB Lab, https://themtblab.com/2018/07/boa-technology-and-mips-partner-for-improved-helmet-fit-and-protection.html (downloaded Jan. 31, 2020).

Delta Plus, https://www.deltaplus.eu/en/article-details/-/article-details/safety-helmets/granite-peak-safety-helmet/p/GRANITEPEAK/ST15/53193/545/53197 (downloaded Jan. 31, 2020).

Delta Plus, https://www.deltaplus.eu/documents/338614/13829902/GB+HELMET+LEAFLET+2016.pdf/9b13ee1c-0e89-4e61-807f-3989efc7a6b5 (downloaded Jan. 31, 2020).

Korean Intellectual Property Office, International Search Report issued in corresponding Application No. PCT/US2019/056970, dated Feb. 6, 2020.

* cited by examiner

RATCHET MECHANISM FOR PROTECTIVE HELMET HEADBAND

CROSS-REFERENCE TO RELATED APPLICATIONS

The present application claims priority to U.S. Patent Application Ser. No. 62/748,014 filed on Oct. 19, 2018, the entire disclosure of which is incorporated herein by reference.

BACKGROUND OF THE INVENTION

The present invention relates to a protective helmet.

Protective helmets are commonly worn in the workplace to prevent or reduce the likelihood of head injuries. For example, a hard hat is the most common and well-recognized protective helmet. For another example, a fire helmet is another common protective helmet. Such protective helmets, including hard hats and fire helmets, commonly are comprised of an outer shell and a headband, along with a suspension and/or internal shock-absorbing liner, which cooperate to reduce the potential for injury by attenuating some translational energy of the force of an impact to the helmet.

The construction of such protective helmets is further described, for example, in U.S. Pat. Nos. 4,888,831, 6,609,254, 6,862,747, 7,000,262, 7,043,772, 7,174,575, and 7,213,271, each of which is assigned to the present applicant and is incorporated herein by reference.

For a protective helmet to provide the appropriate level of protection, it must fit snugly on the wearer's head. Thus, it is common for the headband of a protective helmet to be adjustable to provide for such a snug fit. In this regard, a headband typically has one of two common sizing mechanisms, a pin-lock arrangement or a ratchet mechanism. Regardless of the chosen sizing mechanism, the headband is commonly a flexible, one-piece member that has overlapping rear portions.

With a pin-lock arrangement, a first of the rear portions of the headband is provided with a pin, and the second of the rear portions is provided with a series of holes at spaced intervals. As such, the pin of the first rear end portion can be inserted through one of the holes of the second rear end portion, thus forming a loop of a selected circumference to fit snugly around the wearer's head.

With a ratchet mechanism, lateral movement of the overlapping rear portions of the headband is effectuated through a rack and pinion arrangement or similar gear arrangement. For example, a preferred ratchet mechanism is a rack and pinion arrangement which operates within elongated overlapping slots defined by the rear portions of the headband, each of said slots defining a series of teeth of a rack gear. The rack and pinion arrangement and the overlapping rear portions of the headband are housed between a pair of adjoining arc-shaped housing sections which generally conform to the contour of the wearer's head. The rear portions of the headband are seated for slidable, lateral movement within the arc-shaped housing sections.

Nevertheless, depending on the design of the ratchet mechanism and environmental conditions, it can still be a tedious and time-consuming process for a user to engage the ratchet mechanism and adjust the fit of the headband.

SUMMARY OF THE INVENTION

The present invention is a ratchet mechanism for a headband of a protective helmet.

A protective helmet is generally comprised of: a substantially rigid shell shaped to protect the wearer's head, with the shell defining a bottom opening and an internal cavity for receiving the wearer's head; a headband, which is operably connected to the shell; a ratchet mechanism made in accordance with the present invention; and a shock-absorbing liner positioned in the internal cavity for receiving the wearer's head, i.e., between the shell and the wearer's head. In some embodiments, the protective helmet may include a suspension (in addition to or as an alternative to the shock-absorbing liner) to reduce the potential for injury by attenuating some translational energy of the force of an impact to the helmet.

The headband of the protective helmet includes a front portion which, in use, effectively conforms and is positioned adjacent to the forehead and the respective sides of a user's head. The headband further includes a left rear portion and a right rear portion. Each of the left rear portion and the right rear portion of the headband defines an elongated slot and associated rack gear.

The ratchet mechanism includes a housing, which defines an internal cavity for receiving the left rear portion and the right rear portion of the headband in an overlapping arrangement. The ratchet mechanism further includes: an adjustment element with an integral pinion; a spring; and a knob. The pinion is received in and engages the respective rack gears of the overlapping rear portions of the headband within the internal cavity defined by the housing. The knob is operably connected to the adjustment element, such that rotation of the knob results in rotation of the pinion and causes lateral movement of the overlapping rear portions of the headband with respect to one another to increase or decrease the circumference of the headband.

The spring is a power spring (also commonly referred to as a clock spring or a mainspring) in the form of a preloaded coil of stainless steel (or similar material) that is preset to a predetermined torque setting. The spring is positioned in a cavity that is formed on a lateral face of the adjustment element. Once the spring has been positioned in the cavity, a proximal end of the spring is secured to the adjustment element, thus fixing the position of the proximal end of the spring. A distal end of the spring is then secured to the housing, thus fixing the position of the distal end of the spring.

The ratchet mechanism of the present invention operates in two modes: (i) a micro-adjustment mode; and (ii) an automatic sizing mode. The ratchet mechanism operates in the micro-adjustment mode when it is in a locked state, and the ratchet mechanism operates in the automatic sizing mode when it is in an unlocked state, as further described below.

In assembling the ratchet mechanism, the adjustment element is positioned in the housing. With the proximal and distal ends of the spring fixed in position (to the adjustment element and the housing, respectively) as described above, the adjustment element is rotated around an axis within the housing, such that energy is stored in the spring. The pinion engages the respective rack gears of the overlapping rear portions of the headband in this home position.

A driving gear is operably connected to the knob and is configured to engage and drive the pinion when the knob is rotated. The driving gear includes one or more spring arms, each of which extends from a central portion of the driving gear, and each of which have some inherent flexibility that allows them to deflect (or bend) relative to the central portion of the driving gear. Teeth are located at or near the distal ends of each of the one or more spring arms. In the locked state (micro-adjustment mode), the teeth of the spring arms mate with and engage the corresponding teeth of the ring gear, effectively locking the position of the knob, and thus, locking the position of the overlapping rear portions of the headband relative to the housing. However, when the knob is manually turned by a user, the teeth of the spring arms are forced over the teeth of the ring gear by radially inward compression of the one or more spring arms of the driving gear. In other words, by imparting a sufficient torque on the knob, the user can overcome the spring force and effectuate lateral movement of the overlapping rear portions of the headband relative to one another via rotation of the pinion. Once the user ceases rotation of the knob, the teeth of the one or more spring arms are restored to engagement with the corresponding teeth of the ring gear, again locking the position of the overlapping rear portions of the headband.

To transition the ratchet mechanism to the unlocked state (automatic sizing mode), the user pulls the knob away from the housing. The driving gear moves with the knob; thus, the teeth of the driving gear are pulled away from and disengage from the teeth of the ring gear, and the driving gear is also pulled away from and disengages from the pinion. At this point, the knob is not controlling the rotation of the pinion or the size of the headband. Rather, if the user removes the protective helmet when the ratchet mechanism is in the unlocked state, the spring will rotate the adjustment element back to the home position for the minimum circumference of the headband. In other words, the spring provides a torque that biases the adjustment element to the home position within the internal cavity defined by the housing. If the ratchet mechanism were to be unlocked while on the user's head, it would tighten to the circumference of the user's head.

As a further refinement, in some embodiments, the exemplary ratchet mechanism includes a nape cup, which is configured to swivel relative to the housing, thus effectively providing another degree of self-adjustment in that the nape cup will adjust and conform to the contour of the nape area at the back of the user's head.

DETAILED DESCRIPTION OF THE INVENTION

The present invention is a ratchet mechanism for a headband of a protective helmet.

Figure 1:
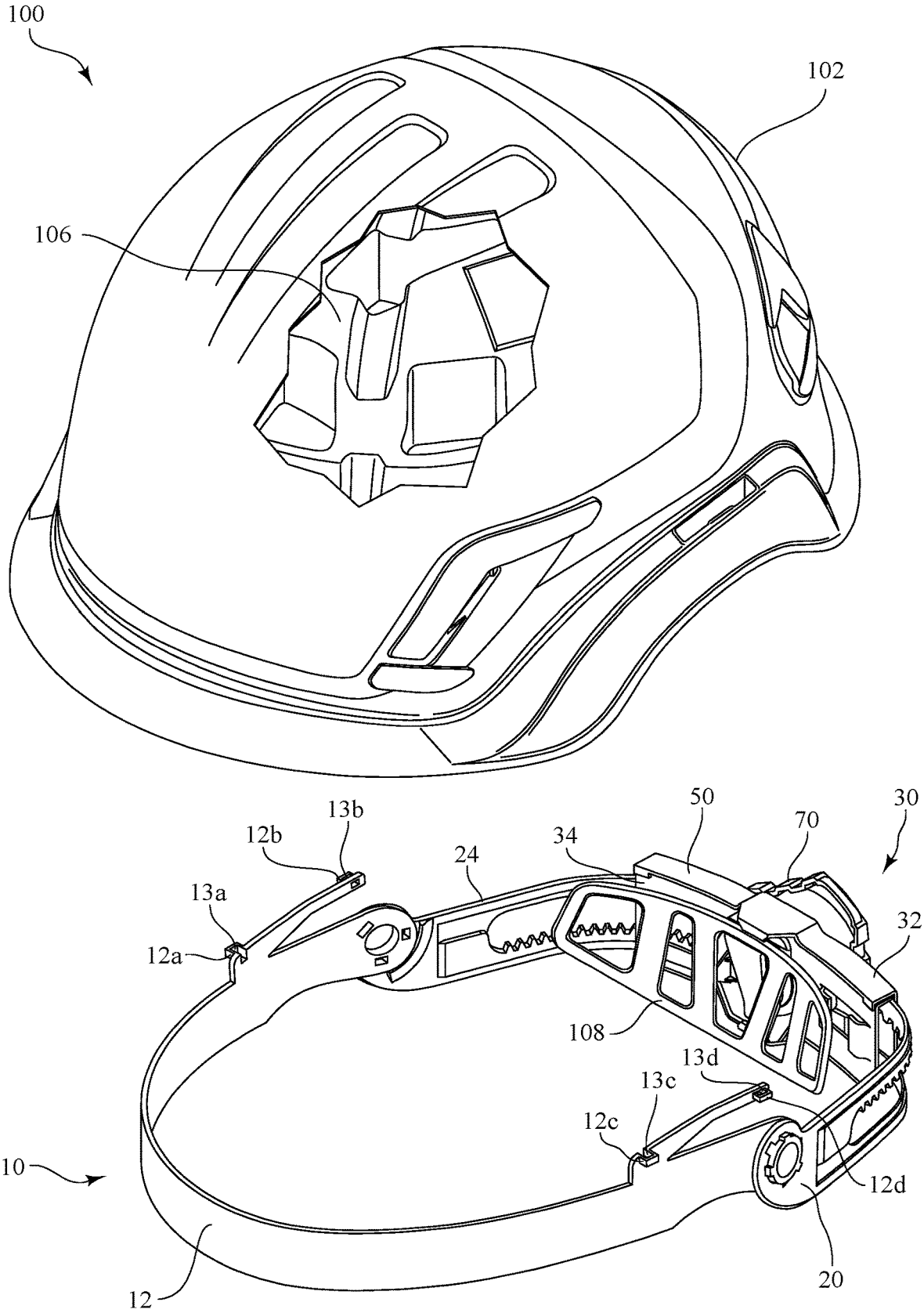
FIG. 1 is a perspective view of a protective helmet that includes a headband and an exemplary ratchet mechanism made in accordance with the present invention.

FIG. 1 is a perspective view of a protective helmet 100 that includes a headband 10 and an exemplary ratchet mechanism 30 made in accordance with the present invention. As shown in FIG. 1, in this exemplary embodiment, the protective helmet 100 is generally comprised of: a substantially rigid shell 102 shaped to protect the wearer's head, with the shell 102 defining a bottom opening and an internal cavity for receiving the wearer's head; the headband 10, which is operably connected to the shell 102; the exemplary ratchet mechanism 30; and a shock-absorbing liner 106 positioned in the internal cavity for receiving the wearer's head, i.e., between the shell 102 and the wearer's head. As noted above, in other embodiments, the protective helmet 100 may include a suspension (in addition to or as an alternative to the shock-absorbing liner) to reduce the potential for injury by attenuating some translational energy of the force of an impact to the helmet. In any event, in the exemplary embodiment shown in FIG. 1, the headband 10 is configured for direct attachment to the shell 102 of the protective helmet 100. Specifically, the front portion 12 of the headband 10 includes multiple integral tabs 12*a-d*, which define cavities 13*a*-13*d* that mate with corresponding integral projections (not shown) that extend from the underside of the shell 102 of the protective helmet 100. Additionally, retainer clips (not shown) may be used to secure the headband 10 in place. Of course, screws or other conventional fasteners could also be used to secure the headband 10 to the shell 102 of the protective helmet 100 without departing from the spirit and scope of the present invention.

Figure 2:
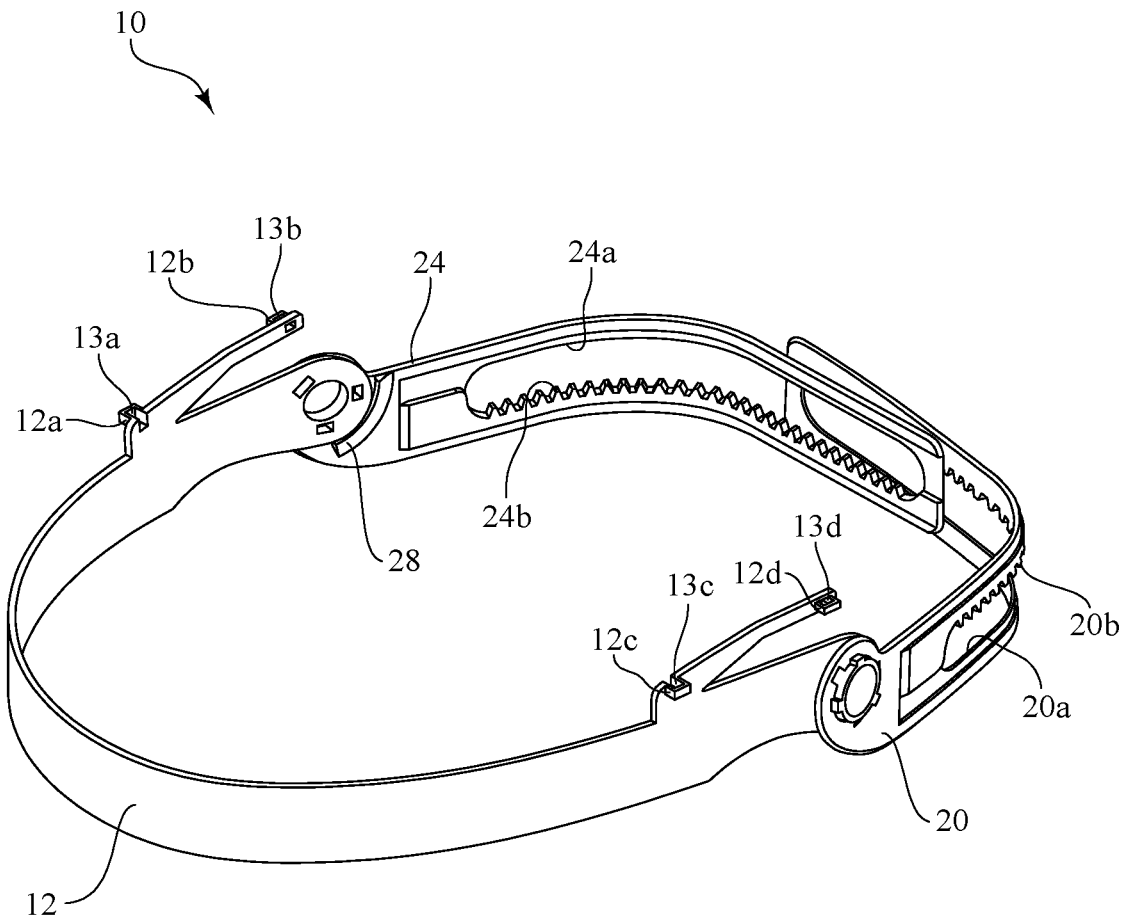
FIG. 2 is a perspective view of the headband of the protective helmet of FIG. 1.

FIG. 2 is a perspective view of the headband 10 of the protective helmet 100 of FIG. 1. As shown in FIG. 2, in this exemplary embodiment, the headband 10 includes a front portion 12 which, in use, effectively conforms and is positioned adjacent to the forehead and the respective sides of a user's head. The headband 10 further includes a left rear portion 20 that is selectively connected to the front portion 12 and a right rear portion 24 that is selectively connected to the front portion 12. The left rear portion 20 and the right rear portion 24 are configured to overlap one another and are engaged by the ratchet mechanism 30, as further described below. Although, in this exemplary embodiment, the headband 10 has multiple parts (i.e., a front portion and left and right rear portions), in other embodiments, the headband may have a unitary construction; in other words, the front portion would not be separable from the rear portions, as shown and described, for example, in U.S. Pat. Nos. 7,000,262, 7,043,772, 7,174,575, and 7,213,271, which have been incorporated herein by reference.

Figure 3:
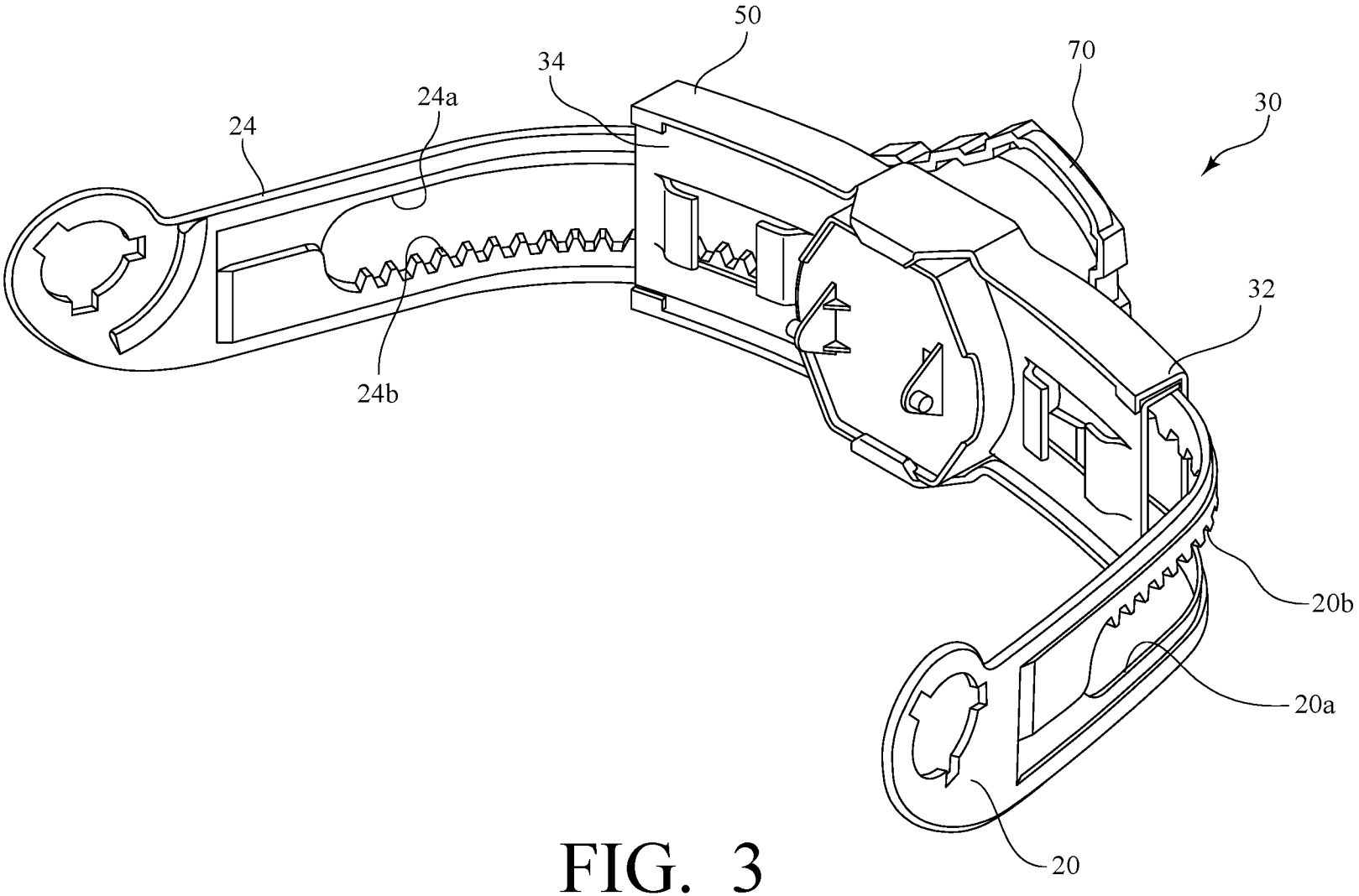
FIG. 3 is a perspective view of the left and right rear portions of the headband and the exemplary ratchet mechanism of the protective helmet of FIG. 1, which secures a position of the left rear portion relative to the right rear portion.

FIG. 3 is a perspective view of the left and right rear portions 20, 24 of the headband 10 and the ratchet mechanism 30, which secures a position of the left rear portion 20 relative to the right rear portion 24. As shown in FIG. 3, each of the left rear portion 20 and the right rear portion 24 of the headband 10 defines an elongated slot 20*a*, 24*a* and associated rack gear 20*b*, 24*b*. The ratchet mechanism 30 includes a housing 32, which is comprised of an outer substantially arc-shaped housing section 50 joined to an inner substantially arc-shaped housing section 34, which collectively define an internal cavity for receiving the left rear portion 20 and the right rear portion 24 of the headband 10 in an overlapping arrangement.

Figure 4:
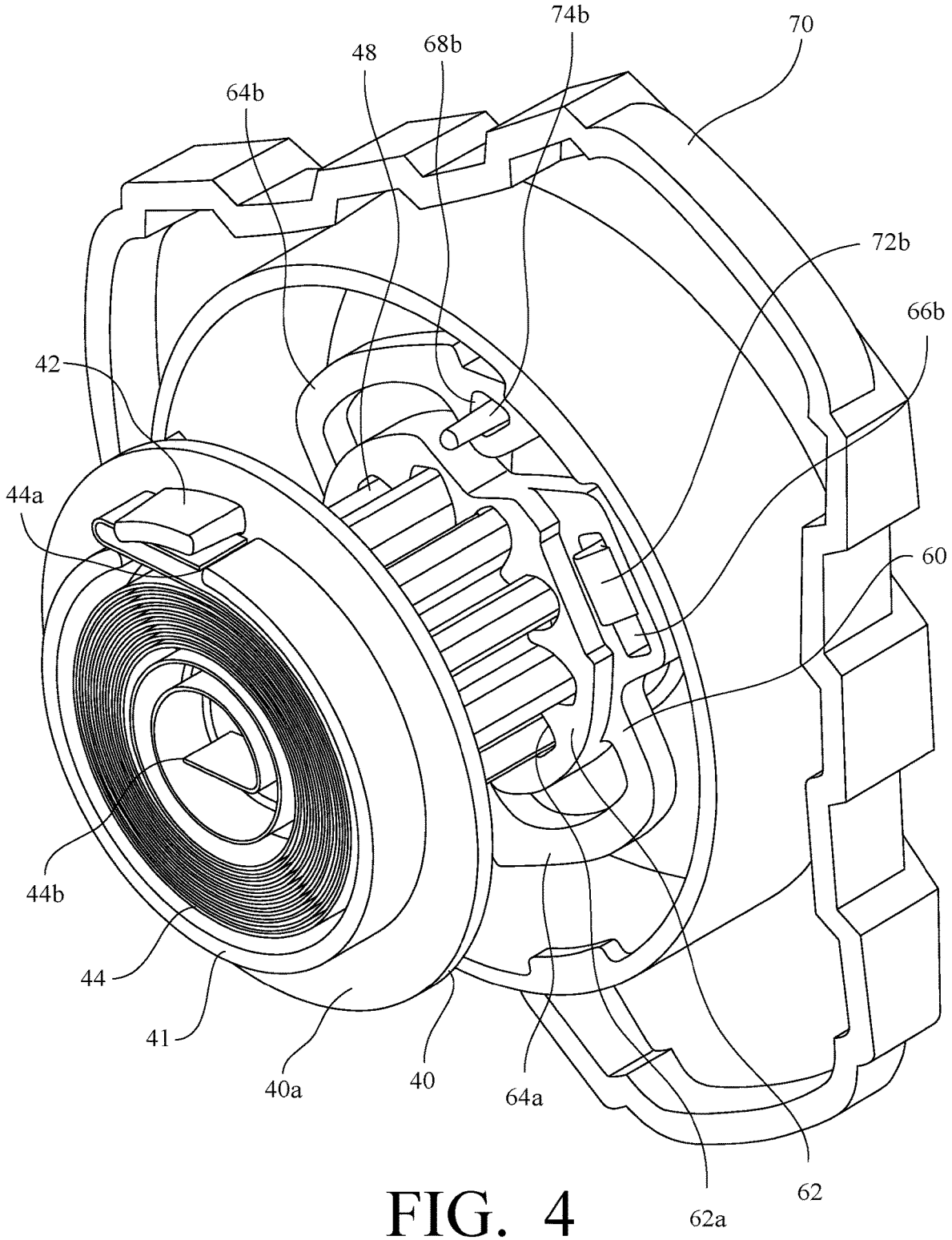
FIG. 4 is an enlarged perspective view of certain internal components of the exemplary ratchet mechanism of the protective helmet of FIG. 1.

FIG. 4 is an enlarged perspective view of certain internal components of the exemplary ratchet mechanism 30.

As shown in FIGS. 3 and 4, in addition to the housing 32, the ratchet mechanism 30 further includes: an adjustment element 40 with an integral pinion 48; a spring 44; and a knob 70. The pinion 48 is received in and engages the respective rack gears 20*b*, 24*b* of the overlapping rear portions 20, 24 of the headband 10 within the internal cavity collectively defined by the outer housing section 50 and the inner housing section 34. The knob 70 is operably connected to the adjustment element 40, such that rotation of the knob 70 results in rotation of the pinion 48 and causes lateral movement of the overlapping rear portions 20, 24 of the headband 10 with respect to one another to increase or decrease the circumference of the headband, as further described below.

Referring now to FIG. 4, the spring 44 is a power spring (also commonly referred to as a clock spring or a mainspring) in the form of a preloaded coil of stainless steel (or similar material) that is preset to a predetermined torque setting. The spring 44 is positioned in a cavity that is formed on a lateral face 40*a* of the adjustment element 40. Specifically, in this exemplary embodiment, the adjustment element 40 is formed from a plastic material and includes an integral circumferential ridge 41 projecting from the lateral face 40*a* of the adjustment element 40 that defines the cavity. Once the spring 44 has been positioned in the cavity, a proximal end 44*a* of the spring 44 is secured to the adjustment element 40.

Figure 4A:
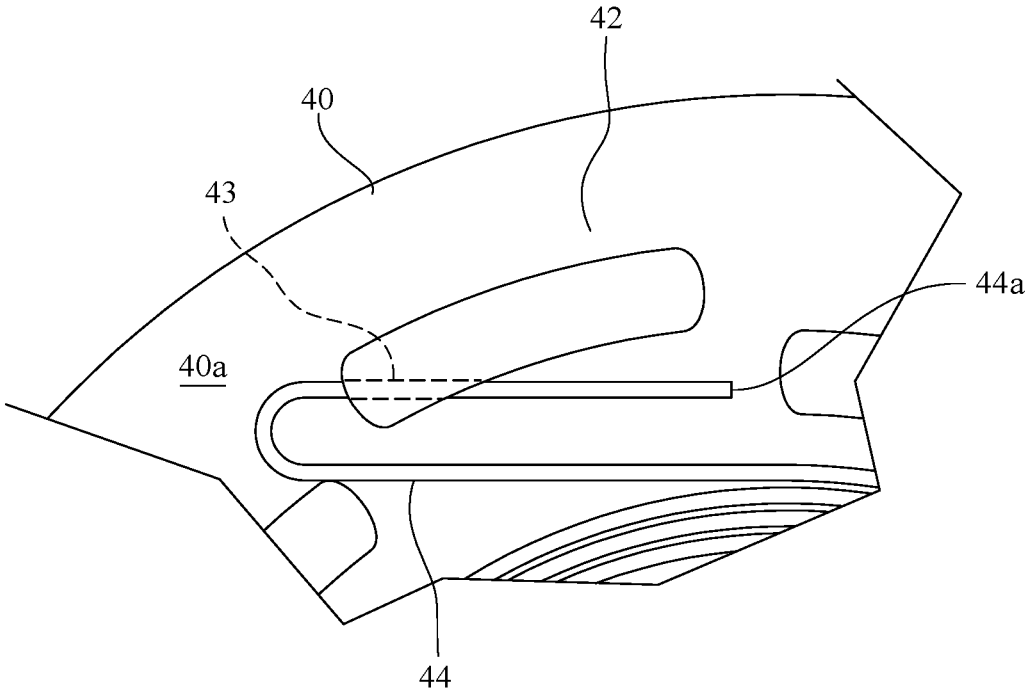
FIG. 4A is an enlarged view of a portion of the adjustment element of the exemplary ratchet mechanism of the protective helmet of FIG. 1.

Referring now to FIG. 4A, in this exemplary embodiment, the adjustment element 40 also includes another projection 42 on its lateral face 40*a*, with a slot 43 defined therethrough. Once the spring 44 has been positioned in the cavity defined by the integral circumferential ridge 41 projecting from the lateral face 40*a* of the adjustment element 40, the proximal end 44*a* of the spring 44 is inserted into the slot 43, thus securing the spring 44 to the adjustment element 40 and fixing the position of the proximal end 44*a* of the spring 44.

The ratchet mechanism 30 of the present invention operates in two modes: (i) a micro-adjustment mode; and (ii) an automatic sizing mode. The ratchet mechanism 30 operates in the micro-adjustment mode when it is in a locked state, and the ratchet mechanism 30 operates in the automatic sizing mode when it is in an unlocked state, as further described below.

Figure 5:
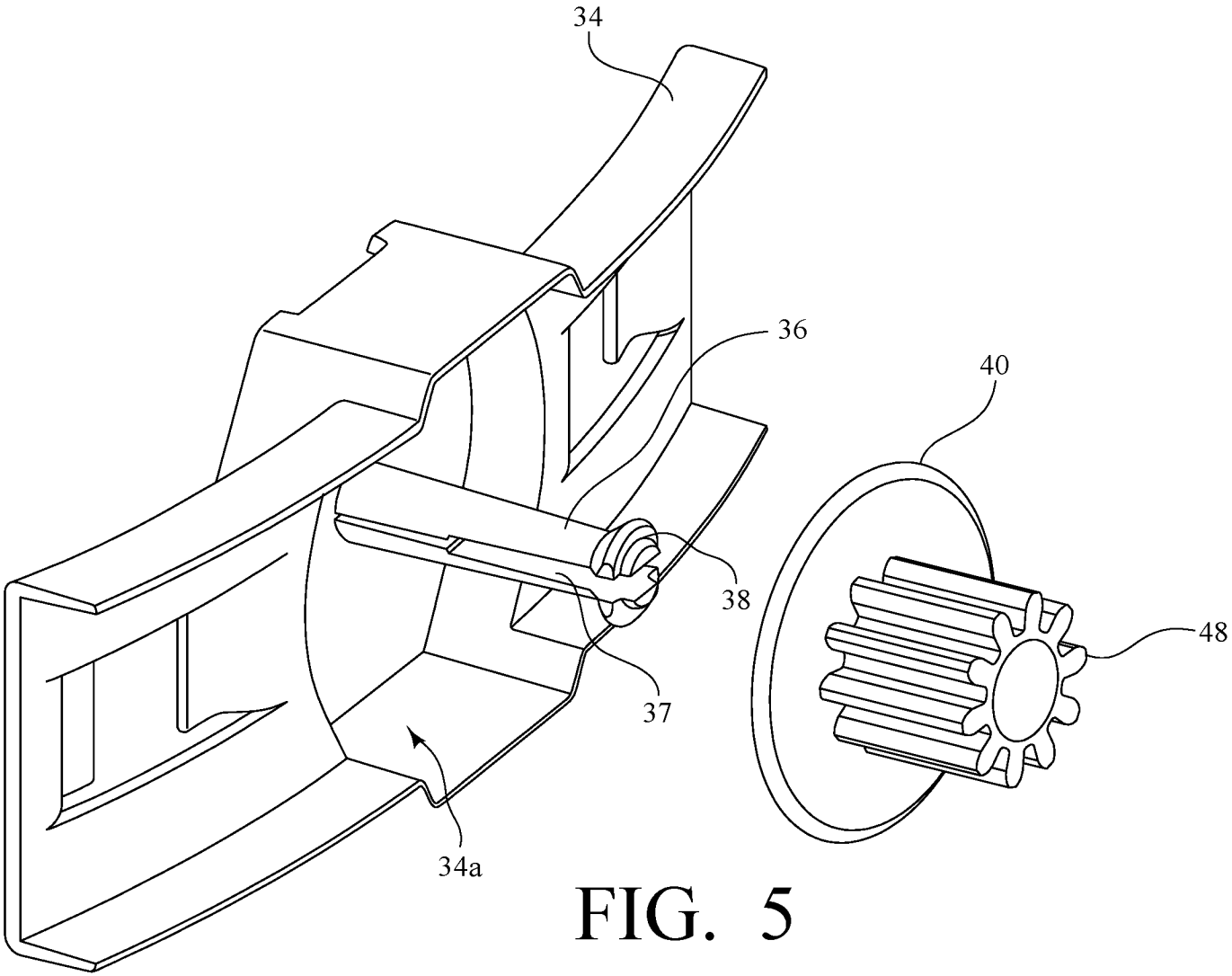
FIG. 5 is a perspective view of the inner housing section and the adjustment element of the exemplary ratchet mechanism of the protective helmet of FIG. 1.

FIG. 5 is a perspective view of the inner housing section 34 and the adjustment element 40 of the exemplary ratchet mechanism 30. As shown, the inner housing section 34 includes a post 36 that projects rearward, with a slit 37 defined through the post 36 substantially along its length, the importance of which is further described below.

Figure 6A:
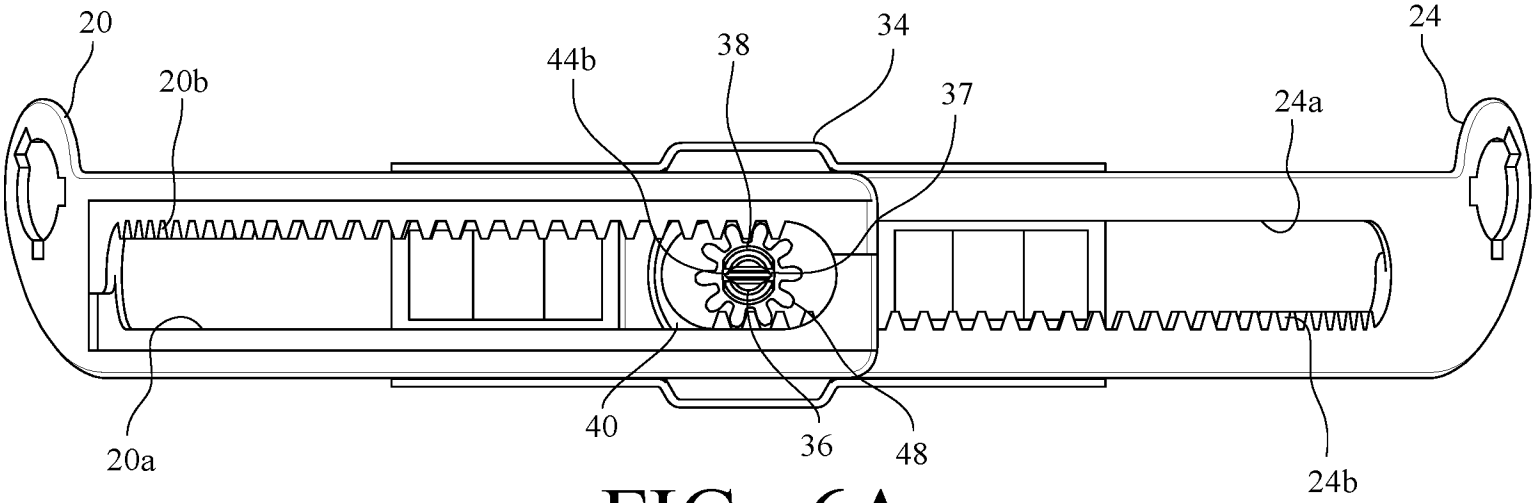
FIG. 6A is a rear view of the assembly of the adjustment element and the inner housing section of the exemplary ratchet mechanism of the protective helmet of FIG. 1, along with the overlapping left rear portion and the right rear portion of the headband.

FIG. 6A is a rear view of the assembly of the adjustment element 40, the inner housing section 34, and the overlapping left rear portion 20 and the right rear portion 24 of the headband 10, with the outer housing section 50 hidden in this view.

Figure 6B:
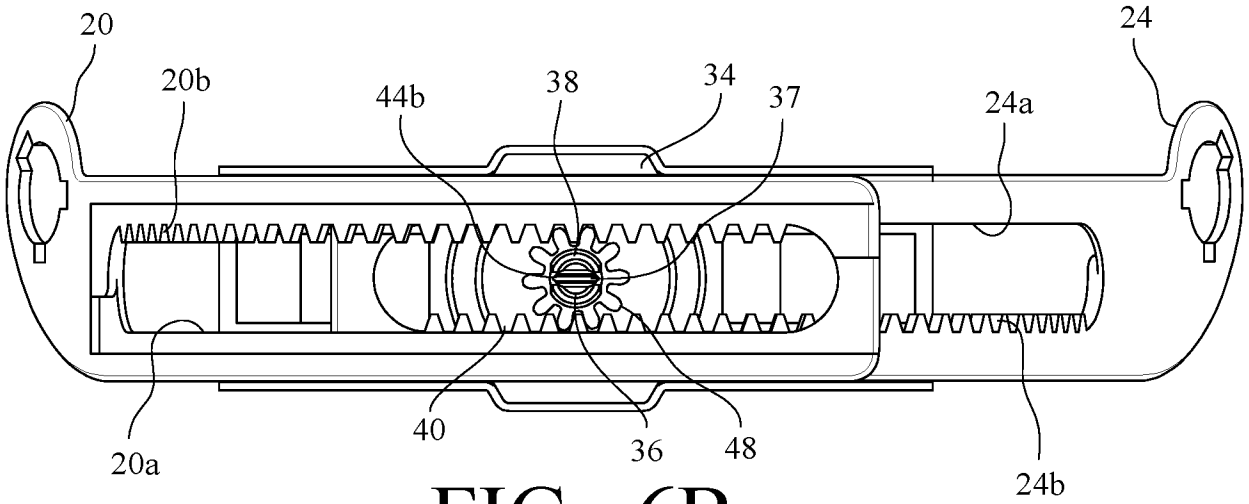
FIG. 6B is another rear view of the assembly of the adjustment element and the inner housing section of the exemplary ratchet mechanism of the protective helmet of FIG. 1, along with the overlapping left rear portion and the right rear portion of the headband.

FIG. 6B is another rear view of the assembly of the adjustment element 40, the inner housing section 34 and the overlapping left rear portion 20 and the right rear portion 24 of the headband 10, with the outer housing section 50 hidden in this view, in which the circumference of the headband 10 has been decreased via use of the adjustment element 40. Specifically, rotation of the pinion 48 (clockwise in FIGS. 6A and 6B) has caused lateral movement of the overlapping rear portions 20, 24 of the headband 10.

Referring now to FIGS. 5, 6A, and 6B, in assembling the ratchet mechanism 30, the adjustment element 40 is positioned in the inner housing section 34, with the post 36 extending through the adjustment element 40. In this regard, and as best shown in FIG. 5, the inner housing section 34 defines a recess 34*a* sized and shaped to receive the adjustment element 40. A distal end 44*b* of the spring 44 is received and secured in the slit 37 defined by the post 36 of the inner housing section 34, thus fixing the position of the distal end 44*b* of the spring 44. The adjustment element 40 is rotated around an axis of rotation defined by the post 36 of the inner housing section 34. Since the proximal and distal ends 44*a*, 44*b* of the spring 44 are fixed, such rotation stores energy in the spring 44. In this case, it is contemplated that the adjustment element 40 would be rotated a predetermined amount (e.g., one revolution) to set the correct torque value for the spring 44. The adjustment element 40 and the spring 44 are held in this home position while the overlapping rear portions 20, 24 of the headband 10 are positioned, such that the pinion 48 engages the respective rack gears 20*b*, 24*b* of the overlapping rear portions 20, 24 of the headband 10. In this regard, the overlapping rear portions 20, 24 of the headband 10 are initially positioned for the minimum circumference of the headband, as shown in FIG. 6B, the importance of which is further described below. Once the overlapping rear portions 20, 24 of the headband 10 are set in this home position, the outer housing section 50 is then assembled to the inner housing section 34.

Figure 7:
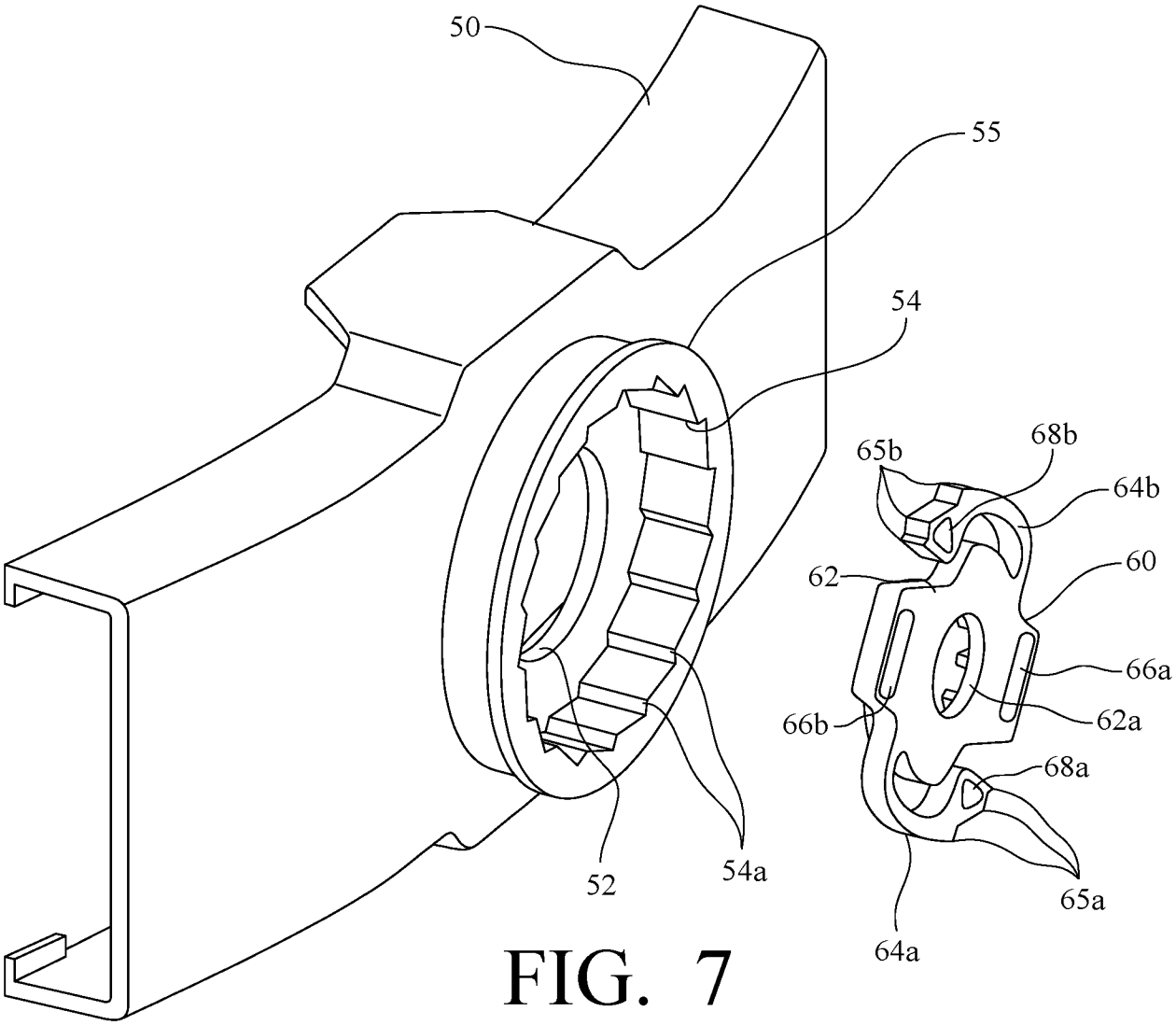
FIG. 7 is a perspective view of the outer housing section and a driving gear that is operably connected to the knob and is configured to engage and drive the pinion of the exemplary ratchet mechanism of the protective helmet of FIG. 1.

FIG. 7 is a perspective view of the outer housing section 50 and a driving gear 60 that is operably connected to the knob 70 and is configured to engage and drive the pinion 48 when the knob 70 is rotated.

Figure 8:
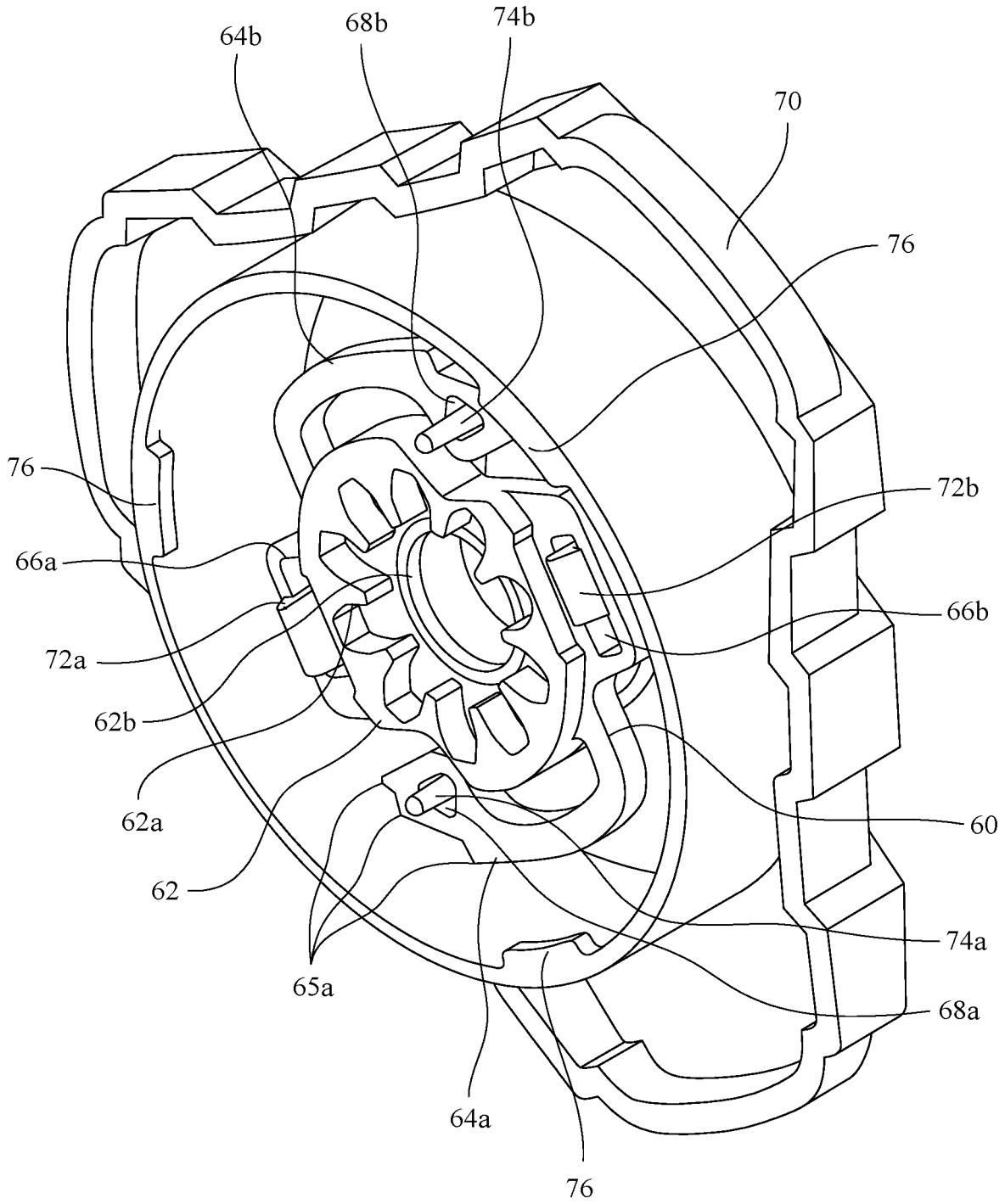
FIG. 8 is a perspective view of the knob, along with the driving gear that is mounted to and operably connected to the knob of the exemplary ratchet mechanism of the protective helmet of FIG. 1.

FIG. 8 is a perspective view of the knob 70, along with the driving gear 60 that is mounted to and operably connected to the knob 70.

Referring now to FIGS. 7 and 8, the central portion 62 of the driving gear 60 defines a cavity 62*a* that has a shape that corresponds with that of the pinion 48. Furthermore, the central portion 62 of the driving gear 60 defines a central opening 62*b* through which the distal end of the post 36 of the inner housing section 34 (as shown in FIG. 5) extends. In this regard, and referring back to FIG. 5, in this exemplary embodiment, the post 36 includes a flange 38 at its distal end. Because of the slit 37 defined through the post 36 substantially along its length, during assembly, the two segments of the post 36 can be squeezed together to advance the flange 38 through the central opening 62*b* defined by the central portion of the driving gear 60. Finally, and referring again to FIGS. 7 and 8, the perimeter of the driving gear 60 is sized and shaped to interact with a ring gear 54 defined in the outer housing section 50 and circumscribing an opening 52 through which the post 36 of the inner housing section 34 extends, as further described below.

As mentioned above, the ratchet mechanism 30 operates in the automatic sizing mode when it is in an unlocked state, and the ratchet mechanism 30 operates in the micro-adjustment mode when it is in a locked state.

Figure 9:
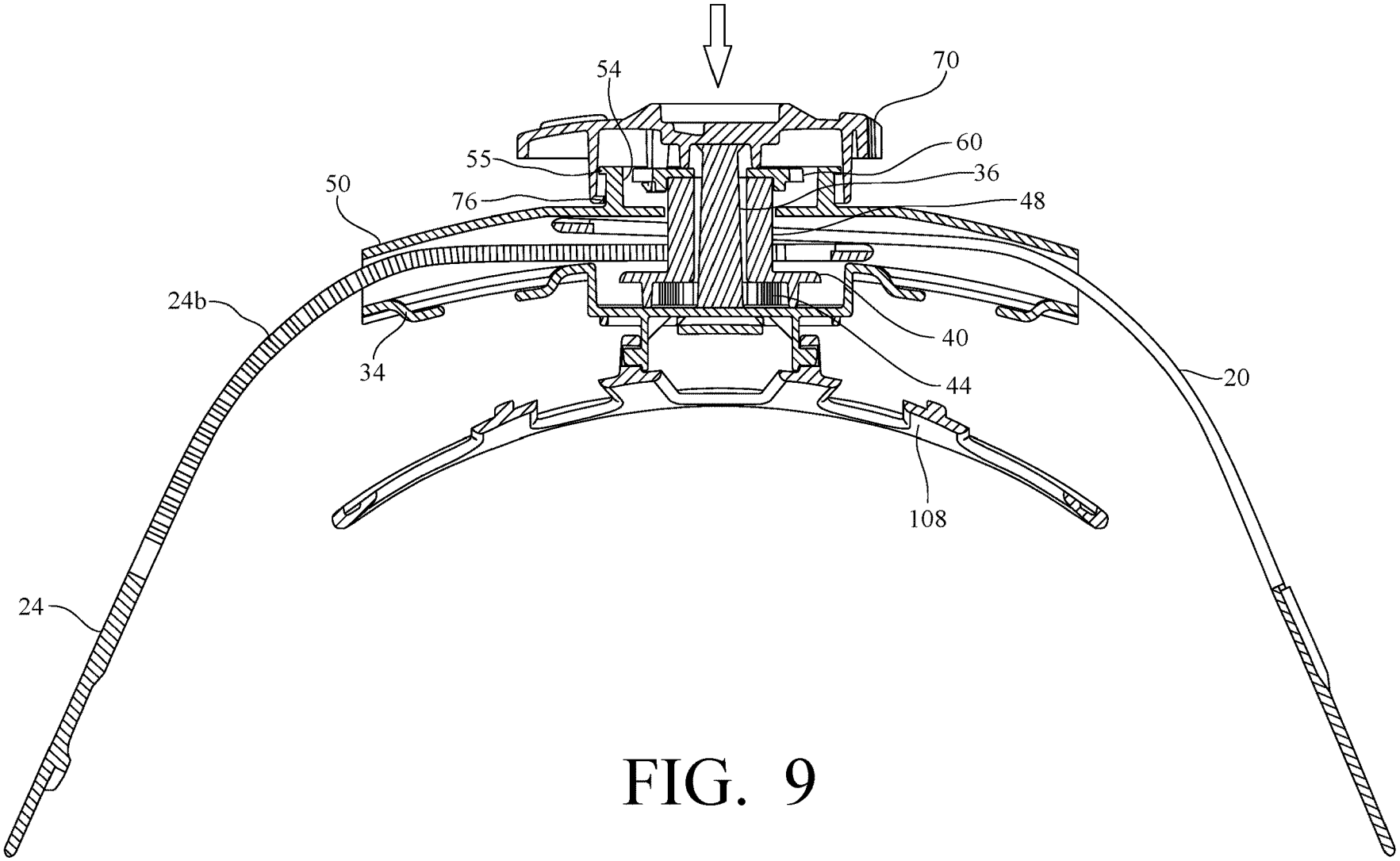
FIG. 9 is a sectional view of the exemplary ratchet mechanism of the protective helmet of FIG. 1 in a locked state for operation of the ratchet mechanism in the micro-adjustment mode, with the knob in a first position.

FIG. 9 is a sectional view of the assembled ratchet mechanism 30 in the locked state for operation of the ratchet mechanism 30 in the micro-adjustment mode, with the knob 70 in a first position.

Referring now to FIGS. 7-9, the perimeter of the driving gear 60 includes teeth 65*a*, 65*b* that mate with and engage corresponding teeth 54*a* of the ring gear 54. Specifically, in this exemplary embodiment, the driving gear 60 includes a first spring arm and a second spring arm 64*a*, 64*b*, each of which extends from the central portion 62 of the driving gear 60. Because the driving gear 60 is preferably formed from a plastic material, the first and second spring arms 64*a*, 64*b* have some inherent flexibility that allows them to deflect (or bend) relative to the central portion 62 of the driving gear 60. Teeth 65*a*, 65*b* are located at or near the distal ends of the respective first and second spring arms 64*a*, 64*b*. In the locked state (micro-adjustment mode), the teeth 65*a*, 65*b* of the first and second spring arms 64*a*, 64*b* mate with and engage the corresponding teeth 54*a* of the ring gear 54, effectively locking the position of the knob 70, and thus, locking the position of the overlapping rear portions 20, 24 of the headband 10 relative to the outer housing section 50. However, when the knob 70 is manually turned by a user (clockwise), the teeth 65*a*, 65*b* of the first and second spring arms 64*a*, 64*b* are forced over the teeth 54*a* of the ring gear 54 by radially inward compression of the first and second spring arms 64*a*, 64*b* of the driving gear 60. In other words, by imparting a sufficient torque on the knob 70, the user can overcome the spring force and effectuate lateral movement of the overlapping rear portions 20, 24 of the headband 10 relative to one another via rotation of the pinion 48. Once the user ceases rotation of the knob 70, the teeth 65*a*, 65*b* of the first and second spring arms 64*a*, 64*b* are restored to engagement with the corresponding teeth 54*a* of the ring gear 54, again locking the position of the overlapping rear portions 20, 24 of the headband 10.

Referring specifically to FIG. 8, it should also be noted that the driving gear 60 is mounted to the knob 70 in a manner that facilitates the movement of the first and second spring arms 64*a*, 64*b*. Specifically, in this exemplary embodiment, the knob 70 includes two integral locking tabs 72*a*, 72*b* that extend through and are received in corresponding slots 66*a*, 66*b* defined by the driving gear 60; however, the locking tabs 72*a*, 72*b* are not rigidly secured in the slots 66*a*, 66*b*. Furthermore, and perhaps more importantly, the knob 70 includes two integral posts 74*a*, 74*b* that extend through and are received in corresponding openings 68*a*, 68*b* defined by the driving gear 60. The openings 68*a*, 68*b* are sized and shaped to accommodate the radially inward compression of the first and second spring arms 64*a*, 64*b* of the driving gear 60, but, at the same time, act as a boundary or limit on the movement of the respective first and second spring arms 64*a*, 64*b*.

Furthermore, and referring still to FIGS. 7-9, the knob 70 can also be rotated in the opposite (counterclockwise) direction, in which case the posts 74*a*, 74*b* move and contact the respective walls of the openings 68*a*, 68*b* of the driving gear 60. Such contact causes the spring arms 64*a*, 64*b* to flex inward, thus disengaging the teeth 65*a*, 65*b* of the first and second spring arms 64*a*, 64*b* from the corresponding teeth 54*a* of the ring gear 54. Thus, by imparting a sufficient torque on the knob 70 in the opposite (counterclockwise) direction, the user can also effectuate lateral movement of the overlapping rear portions 20, 24 of the headband 10 relative to one another via rotation of the pinion 48. Once the user ceases rotation of the knob 70, the posts 74*a*, 74*b* are no longer engaging the openings 68*a*, 68*b* of the driving gear 60, causing the teeth 65*a*, 65*b* of the first and second spring arms 64*a*, 64*b* to be restored to engagement with the corresponding teeth 54*a* of the ring gear 54, again locking the position of the overlapping rear portions 20, 24 of the headband 10.

Figure 8A:
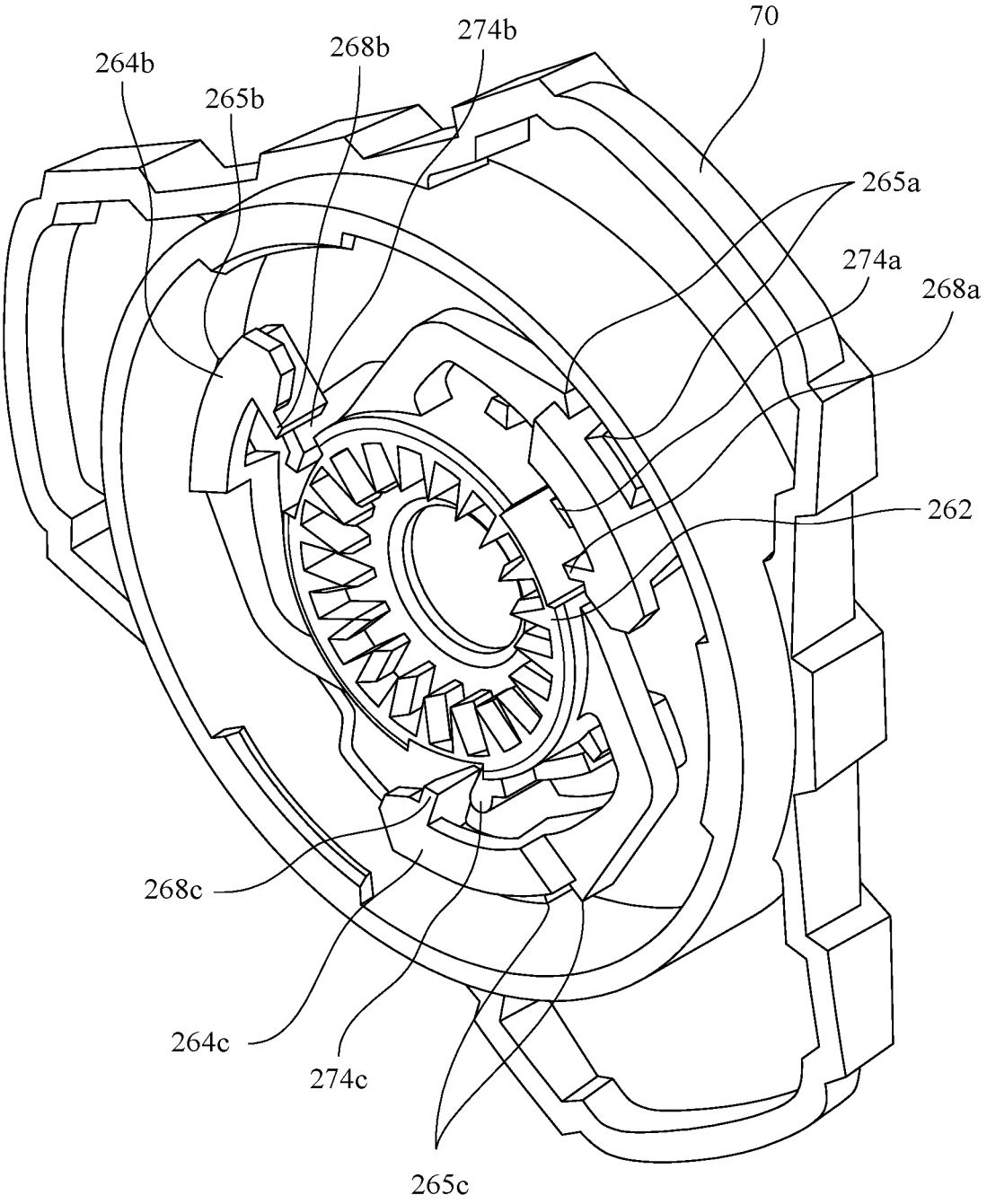
FIG. 8A is a perspective view of the knob similar to FIG. 8, but illustrating an alternate driving gear that is mounted to and operably connected to the knob.

In other embodiments, the driving gear may include fewer (one) or more spring arms, but the functionality would be the same, i.e., to provide a means to lock the position of the knob 70, and thus, lock the position of the overlapping rear portions 20, 24 of the headband 10 relative to the outer housing section 50 until a sufficient torque is imparted on the knob 70 to overcome the spring force. For example, FIG. 8A is a perspective view of the knob 70 with an alternate driving gear 260 that has three spring arms 264*a*, 264*b*, 264*c*, each of which extends from the central portion 262 of the driving gear 260. Because the driving gear 260 is preferably formed from a plastic material, the spring arms 264*a*, 264*b*, 264*c* have some inherent flexibility that allows them to deflect (or bend) relative to the central portion 262 of the driving gear 260. One or more teeth 265*a*, 265*b*, 265*c* are located near the ends of the respective spring arms 264*a*, 264*b*, 264*c*. In the locked state (micro-adjustment mode), the teeth 265*a*, 265*b*, 265*c* of the spring arms 264*a*, 264*b*, 264*c* mate with and engage the corresponding teeth 54*a* of the ring gear 54, effectively locking the position of the knob 70, and thus, locking the position of the overlapping rear portions 20, 24 of the headband 10 relative to the outer housing section 50. However, when the knob 70 is manually turned by a user (clockwise), the teeth 265*a*, 265*b*, 265*c* of the spring arms 264*a*, 264*b*, 264*c* are forced over the teeth 54*a* of the ring gear 54 by radially inward compression of the spring arms 264*a*, 264*b*, 264*c* of the driving gear 260. In other words, by imparting a sufficient torque on the knob 70, the user can overcome the spring force and effectuate lateral movement of the overlapping rear portions 20, 24 of the headband 10 relative to one another via rotation of the pinion 48. (In FIG. 8A, the central portion 262 is also depicted as defining a cavity with a shape that corresponds to that of an alternate pinion, but the function is still the same.) Once the user ceases rotation of the knob 70, the teeth 265*a*, 265*b*, 265*c* of the spring arms 264*a*, 264*b*, 264*c* are restored to engagement with the corresponding teeth 54*a* of the ring gear 54, again locking the position of the overlapping rear portions 20, 24 of the headband 10.

Referring still to FIG. 8A, the knob 70 includes integral projections 274*a*, 274*b*, 274*c* that function in a similar manner to the posts 74*a*, 74*b* described above with respect to FIG. 8. Specifically, when the knob 70 is rotated in the opposite (counterclockwise) direction, the projections 274*a*, 274*b*, 274*c* move and contact inner flanges 268*a*, 268*b*, 268*c* defined by each of the spring arms 264*a*, 264*b*, 264*c* of the driving gear 260. Such contact causes the spring arms 264*a*, 264*b*, 264*c* to flex inward, thus disengaging the teeth 265*a*,

265*b*, 265*c* of the spring arms 264*a*, 264*b*, 264*c* from the corresponding teeth 54*a* of the ring gear 54. Thus, by imparting a sufficient torque on the knob 70 in the opposite (counterclockwise) direction, the user can also effectuate lateral movement of the overlapping rear portions 20, 24 of the headband 10 relative to one another via rotation of the pinion 48. Once the user ceases rotation of the knob 70, the projections 274*a*, 274*b*, 274*c* are no longer engaging the inner flanges 268*a*, 268*b*, 268*c* of the spring arms 264*a*, 264*b*, 264*c*, causing the teeth 265*a*, 265*b*, 265*c* of the spring arms 264*a*, 264*b*, 264*c* to be restored to engagement with the corresponding teeth 54*a* of the ring gear 54, again locking the position of the overlapping rear portions 20, 24 of the headband 10.

Figure 10:
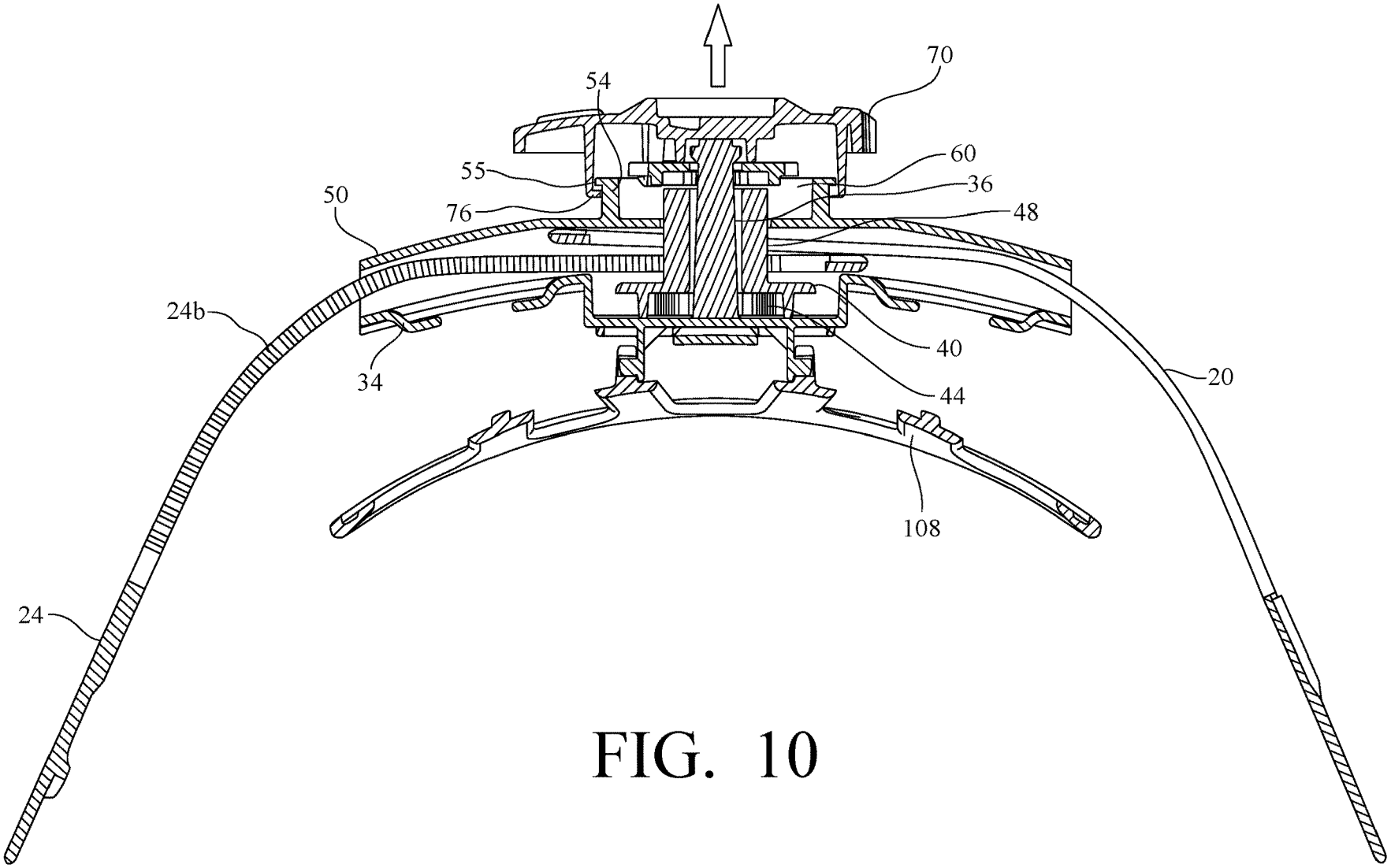
FIG. 10 is a sectional view of the exemplary ratchet mechanism of the protective helmet of FIG. 1 in an unlocked state for operation of the ratchet mechanism in the automatic sizing mode, with the knob in a second position.

FIG. 10 is a sectional view of the assembled ratchet mechanism 30 in the unlocked state for operation of the ratchet mechanism 30 in the automatic sizing mode, with the knob 70 in a second position.

As shown in FIG. 10, to transition the ratchet mechanism 30 to the unlocked state, the user pulls the knob 70 away from the outer housing section 50. In doing so, movement of the knob 70 relative to the outer housing section 50 is limited by the interaction of a flange 55 that circumscribes the ring gear 54 (as also shown in FIG. 7) and integral tabs 74 on the bottom side of the knob 70 (as also shown in FIG. 8). In any event, the driving gear 64 moves with the knob 70; thus, the teeth 65*a*, 65*b* of the driving gear 60 are pulled away from and disengage from the teeth 54*a* of the ring gear 54, and the driving gear 60 is also pulled away from and disengages from the pinion 48. At this point, the knob 70 is not controlling the rotation of the pinion 48 or the size of the headband 10 (FIG. 1). Rather, if the user removes the protective helmet 100 (FIG. 1) when the ratchet mechanism 30 is in the unlocked state, the spring 44 will rotate the adjustment element 40 back to the home position for the minimum circumference of the headband. In other words, the spring 44 provides a torque that biases the adjustment element 40 to the home position within the internal cavity collectively defined by the inner housing section 34 and the outer housing section 50. If the ratchet mechanism were to be unlocked while on the user's head, it would tighten to the circumference of the user's head.

Lastly, as a further refinement, and as shown in FIGS. 1, 9, and 10, this exemplary ratchet mechanism 30 includes a nape cup 108, which is configured to swivel relative to the inner housing section 34, thus effectively providing another degree of self-adjustment in that the nape cup 108 will adjust and conform to the contour of the nape area at the back of the user's head.

One of ordinary skill in the art will recognize that additional embodiments are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A ratchet mechanism for a headband of a protective helmet, which controls movement of overlapping rear portions of the headband with respect to one another, comprising:

a housing defining an internal cavity;

an adjustment element with a pinion configured to engage respective rack gears of the overlapping rear portions of the headband within the internal cavity defined by the housing, along with a spring, which provides a torque that biases the adjustment element to a home position; and a knob that is configured for movement between a first position in which it engages the pinion and controls rotation of the adjustment element, such that the knob can be rotated in a first direction to increase a circumference of the headband and rotated in a second direction to decrease the circumference of the headband, and a second position in which it disengages from the pinion, such that the spring will cause the adjustment element to rotate in the second direction toward the home position, decreasing the circumference of the headband.

2. The ratchet mechanism as recited in claim 1, wherein the spring is positioned in a cavity that is formed on a lateral face of the adjustment element.

3. The ratchet mechanism as recited in claim 2, wherein the cavity is defined by a circumferential ridge projecting from the lateral face of the adjustment element.

4. The ratchet mechanism as recited in claim 1, in which the housing includes:

an inner housing section; and an outer housing section assembled to the inner housing section, thus defining the internal cavity in which the overlapping rear portions of the headband are received.

5. The ratchet mechanism as recited in claim 4, wherein a proximal end of the spring is secured to the adjustment element and a distal end of the spring is secured to the inner housing section.

6. The ratchet mechanism as recited in claim 5, wherein the spring is positioned in a cavity that is formed on a lateral face of the adjustment element.

7. The ratchet mechanism as recited in claim 6, wherein the adjustment element includes a projection on the lateral face, with a slot defined therethrough, and with the proximal end of the spring being inserted into the slot, thus securing the spring to the adjustment element.

8. The ratchet mechanism as recited in claim 5, wherein the inner housing section includes a post that projects rearward, with a slit defined through the post substantially along its length, and with the distal end of the spring received and secured in the slit.

9. The ratchet mechanism as recited in claim 8, wherein the adjustment element rotates about an axis of rotation defined by the post.

10. The ratchet mechanism as recited in claim 1, and further comprising a driving gear that is operably connected to the knob and is configured to engage and drive the pinion.

11. The ratchet mechanism as recited in claim 10, wherein the driving gear is sized and shaped to interact with a ring gear defined by the housing.

12. The ratchet mechanism as recited in claim 11, wherein the driving gear includes one or more spring arms, with each of the one or more spring arms including teeth that mate with and engage corresponding teeth of the ring gear.

13. The ratchet mechanism as recited in claim 12, wherein the knob is moved from the first position to the second position by pulling the knob away from the housing.

14. A protective helmet adapted to receive and protect a wearer's head, comprising:

a shell shaped to protect the wearer's head, the shell defining a bottom opening and an internal cavity for receiving the wearer's head;

a headband operably connected to the shell and including overlapping rear portions; and a ratchet mechanism, including a housing defining an internal cavity, an adjustment element with a pinion configured to engage respective rack gears of the overlapping rear portions of the headband within the internal cavity defined by the housing, along with a spring, which provides a torque that biases the adjustment element to a home position, and a knob that is configured for movement between a first position in which it engages the pinion and controls rotation of the adjustment element, such that the knob can be rotated in a first direction to increase a circumference of the headband and rotated in a second direction to decrease the circumference of the headband, and a second position in which it disengages from the pinion, such that the spring will cause the adjustment element to rotate in the second direction toward the home position, decreasing the circumference of the headband.

15. The protective helmet as recited in claim 14, in which the housing includes:

an inner housing section; and an outer housing section assembled to the inner housing section, thus defining the internal cavity in which the overlapping rear portions of the headband are received.

16. The protective helmet as recited in claim 15, wherein a proximal end of the spring is secured to the adjustment element and a distal end of the spring is secured to the inner housing section.

17. The protective helmet as recited in claim 14, and further comprising a driving gear that is operably connected to the knob and is configured to engage and drive the pinion.

18. The protective helmet as recited in claim 17, wherein the driving gear is sized and shaped to interact with a ring gear defined by the housing.

19. The protective helmet as recited in claim 18, wherein the driving gear includes one or more spring arms, with each of the one or more spring arms including teeth that mate with and engage corresponding teeth of the ring gear.

20. The protective helmet as recited in claim 14, wherein the knob is moved from the first position to the second position by pulling the knob away from the housing.

21. A ratchet mechanism for a headband of a protective helmet, which controls movement of overlapping rear portions of the headband with respect to one another, comprising:

a housing defining an internal cavity;

an adjustment element with a pinion configured to engage respective rack gears of the overlapping rear portions of the headband within the internal cavity defined by the housing, along with a spring, which provides a torque that biases the adjustment element to a home position;

a knob that is configured for movement between a first position in which it engages the pinion and controls rotation of the adjustment element, and a second position in which it disengages from the pinion, such that the spring will cause the adjustment element to rotate toward the home position; and a driving gear that is operably connected to the knob and is configured to engage and drive the pinion, wherein the driving gear is sized and shaped to interact with a ring gear defined by the housing, and wherein the driving gear includes one or more spring arms, with each of the one or more spring arms including teeth that mate with and engage corresponding teeth of the ring gear.

22. A protective helmet adapted to receive and protect a wearer's head, comprising:

a shell shaped to protect the wearer's head, the shell defining a bottom opening and an internal cavity for receiving the wearer's head;

a headband operably connected to the shell and including overlapping rear portions; and a ratchet mechanism, including a housing defining an internal cavity, an adjustment element with a pinion configured to engage respective rack gears of the overlapping rear portions of the headband within the internal cavity defined by the housing, along with a spring, which provides a torque that biases the adjustment element to a home position, a knob that is configured for movement between a first position in which it engages the pinion and controls rotation of the adjustment element, and a second position in which it disengages from the pinion, such that the spring will cause the adjustment element to rotate toward the home position, and a driving gear that is operably connected to the knob and is configured to engage and drive the pinion, wherein the driving gear is sized and shaped to interact with a ring gear defined by the housing, and wherein the driving gear includes one or more spring arms, with each of the one or more spring arms including teeth that mate with and engage corresponding teeth of the ring gear.

23. A ratchet mechanism for a headband of a protective helmet, which controls movement of overlapping rear portions of the headband with respect to one another, comprising:

a housing defining an internal cavity;

an adjustment element with a pinion configured to engage respective rack gears of the overlapping rear portions of the headband within the internal cavity defined by the housing, along with a spring, which provides a torque that biases the adjustment element to a home position; and a knob that selectively engages the pinion;

wherein, when the knob is in a first position in which it engages the pinion, the ratchet mechanism operates in a first mode, with rotation of the knob in a first direction causing a corresponding rotation of the pinion and the adjustment element in the first direction, thus increasing a circumference of the headband, and with rotation of the knob in a second direction causing a corresponding rotation of the pinion and the adjustment element in the second direction, thus decreasing the circumference of the headband; and wherein, when the knob is in a second position in which it is disengaged from the pinion, the ratchet mechanism operates in a second mode, with the spring causing rotation of the adjustment element in the second direction toward the home position, thus decreasing the circumference of the headband.

* * * * *